US006801599B1

(12) United States Patent
Kautz et al.

(10) Patent No.: US 6,801,599 B1
(45) Date of Patent: Oct. 5, 2004

(54) X-RAY TUBE CATHODE CUP STRUCTURE FOR FOCAL SPOT DEFLECTION

(75) Inventors: Allan D. Kautz, Naperville, IL (US); Salvatore G. Perno, Winfield, IL (US)

(73) Assignee: Koninklijke Philips Electronics, N.V., Eindhoven (NL)

( * ) Notice: Subject to any disclaimer, the term of this patent is extended or adjusted under 35 U.S.C. 154(b) by 204 days.

(21) Appl. No.: 10/078,604

(22) Filed: Feb. 19, 2002

Related U.S. Application Data

(63) Continuation-in-part of application No. 09/989,864, filed on Nov. 20, 2001.

(51) Int. Cl.[7] ..... H01J 35/14
(52) U.S. Cl. ..... 378/138
(58) Field of Search ..... 378/136, 137, 378/138

(56) References Cited

U.S. PATENT DOCUMENTS 2,215,426 A 9/1940 Machlett ..... 250/144
3,688,147 A * 8/1972 Raago ..... 313/496
3,916,202 A 10/1975 Heiting et al. ..... 250/403
4,641,103 A * 2/1987 Madey et al. ..... 315/507
5,065,420 A 11/1991 Levene
5,125,019 A 6/1992 Evain et al.
5,224,143 A 6/1993 Dumitrescu et al.
5,418,348 A * 5/1995 Tsujimoto et al. ..... 219/121.15
5,621,276 A * 4/1997 Songer ..... 315/14
5,970,117 A 10/1999 Basinger ..... 378/136
6,480,572 B2 * 11/2002 Harris et al. ..... 378/136

* cited by examiner

*Primary Examiner*—Max Noori
(74) *Attorney, Agent, or Firm*—Fay Sharpe, Fagan, Minnich & McKee, LLP

(57) ABSTRACT

A cathode assembly (18, 216) for an x-ray tube (1) includes a base (60, 220) to which a filament (66) is mounted. A pair of deflectors (82, 84) are carried by the base for deflecting a beam (A) of electrons generated by the filament. Metal tubes (130, 132) are mounted in bores (106) of insulator blocks (104, 105). Metalized ends (150) of the insulator blocks are brazed into bores (122, 222, 224) in the base. A rod (130, 132) attached to the deflector is slid into the tube and the deflector's position and alignment are gauged and accurately set. The rod and tube are crimped to set the deflector position then welded.

23 Claims, 7 Drawing Sheets

X-RAY TUBE CATHODE CUP STRUCTURE FOR FOCAL SPOT DEFLECTION

This application is a Continuation-in-Part of U.S. application Ser. No. 09/989,864, filed Nov. 20, 2001.

BACKGROUND OF THE INVENTION

The present invention pertains to the vacuum tube arts, and in particular to an x-ray tube cathode cup structure for deflecting a focal spot of a beam of electrons. It finds particular application in conjunction with rotating anode x-ray tubes for CT scanners and will be described with particular reference thereto. However, it is to be appreciated that the present invention will also find application in the generation of radiation and in vacuum tubes for other applications.

Conventional x-ray tubes include a vacuum enclosure and a source of a beam of electrons in the form of a cathode. The cathode includes a heated filament which emits electrons. The impact of the electron beam on the anode causes a beam of x-radiation to be emitted from the x-ray tube, typically through a beryllium window. A trend toward shorter x-ray exposure times in radiography has placed an emphasis on having a greater intensity of radiation and hence higher electron currents. Increasing the intensity can cause overheating of the x-ray tube anode. An electrical bias voltage is applied to the beam of electrons in order to control, to some extent, the size of the focal spot.

One way to control the size of the focal spot of the electrons on the anode more closely is to mount the cathode filament within a cathode focusing or support cup member. Such a system is shown in U.S. Pat. No. 4,689,809. A cathode cup is split into two portions, surrounding the filament, The portions are biased equal to or negative with respect to the filament. The biased cup reduces unwanted "wings," or diffused areas, appearing as part of the x-ray focal spot.

Other cathode cup and filament arrangements for controlling the size and shape of the electron focal spot on the tube anode are discussed in U.S. Pat. Nos. 4,685,118, 5,224,143, and 5,065,420.

To minimize the power requirements of the focussing system and to maintain accurate positioning of the filament relative to the deflectors, it is desirable to mount both the deflectors and the filament to the same support. Cathode cups thus typically include a base or arm portion which supports the filament and a pair of deflectors. The deflectors are mechanically mounted to the base, but are electrically insulated from it. This is achieved through the use of ceramic insulators which are brazed to both the base and the deflectors in the form of a sandwich. The ceramic insulators include central bores through which a bolt is received for maintaining alignment of the components during brazing. To avoid shorting, the bolt is electrically isolated from the base. Such a cathode cup design is difficult to assemble, difficult to align, and is susceptible to shorting. This can occur if the material used to braze the ceramic insulator to the base or the deflector flows into the insulator bore that receives the bolt. Shorting can also occur due to natural plating of the ceramic insulator with metal vapor from the filament.

The present invention provides a new and improved x-ray tube and method which overcomes the above-referenced problems and others.

SUMMARY OF THE INVENTION

In accordance with one aspect of the present invention, a cathode assembly is provided. The assembly includes a base.

A filament is mounted to the base for delivering a stream of electrons. A deflector is carried by the base for deflecting the electrons and/or focusing the electrons into a beam. An insulator electrically insulates the deflector from the base. The insulator defines a bore. A rod is connected with the deflector adjacent a first end of the rod. The rod is received within the insulator bore.

In accordance with another aspect of the present invention, an x ray tube is provided. The x-ray tube includes an envelope which encloses an evacuated chamber. A cathode assembly is disposed within the chamber for providing a source of electrons. The cathode assembly includes a base supported in the envelope. A filament is mounted to the base for providing the electrons. A deflector is carried by the base for deflecting the electrons and/or focusing the electrons into a beam. An insulator electrically insulates the deflector from the base. The insulator defines a bore. A rod is connected with the deflector adjacent a first end of the rod, the rod being received within the insulator bore. An anode is disposed within the chamber and positioned to be struck by the electrons and generate x-rays.

In accordance with another aspect of the present invention, a method of assembling a cathode assembly is provided. The method includes attaching at least one rod to at least one deflector and attaching a metal tube in an insulator to define a bore for receiving the rod. The insulator is attached to a base. A filament assembly is attached to the base. The method further includes sliding the rod into the tube to mount the deflector to the base and attaching the rod to the tube.

One advantage of at least one embodiment of the present invention is that a cathode cup is electrically isolated from a filament.

Another advantage of at least one embodiment of the present invention is that deflectors of a cathode cup are readily aligned with a filament.

Another advantage of at least one embodiment of the present invention is that components of a cathode cup are accurately aligned.

Another advantage of at least one embodiment of the present invention is that deposition of vaporized filament material on to insulators which space the deflectors from a base assembly is minimized by reducing the line of sight between the filament and the insulators.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
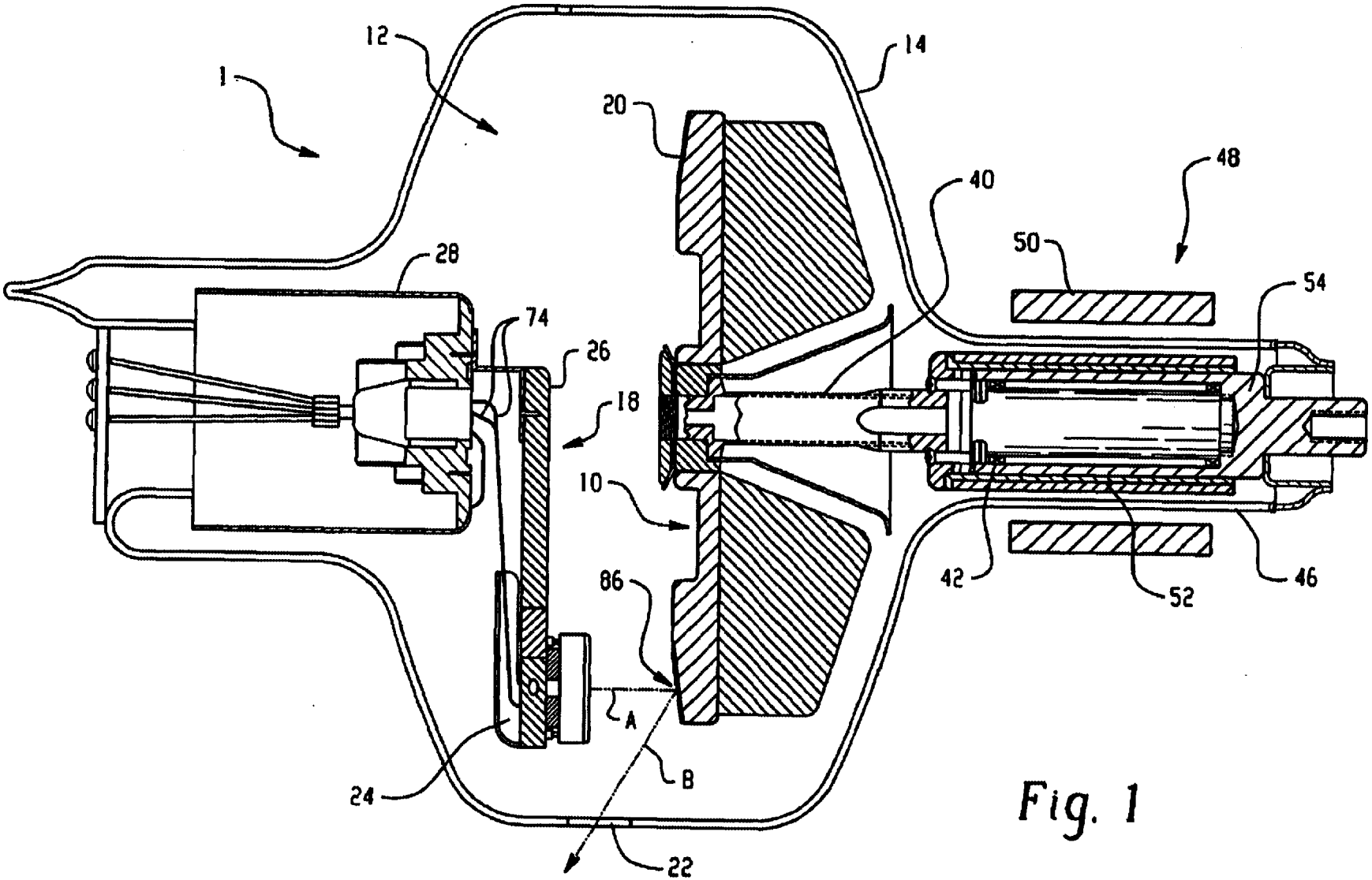
FIG. 1 is a schematic sectional view of a rotating anode x-ray tube according to the present invention.

With reference to FIG. 1, a rotating anode x-ray tube 1 of the type used in medical diagnostic systems for providing a beam of x-ray radiation is shown. The tube includes an anode 10 which is rotatably mounted in an evacuated chamber 12, defined by an envelope or frame 14. A heated element cathode assembly 18 supplies and focuses an electron beam A. The cathode is biased, relative to the anode 10 such that the electron beam flows to the anode and strikes a target area 20 of the anode. A portion of the beam striking the target area is converted to x-rays B, which are emitted from the x-ray tube through a window 22 in the envelope. The cathode assembly includes a cathode cup or head 24, which is supported in the envelope by an arm 26 of the cathode assembly 18, which is connected at its other end to a central support structure 28.

The target 20 of the anode is connected to a shaft 40, which is supported by bearings 42 in a neck portion 46 of the evacuated envelope 14 and driven by an induction motor 48. The induction motor includes a stator 50, outside the envelope, which rotates a rotor 52 connected to the shaft relative to a stationary bearing housing 54. The anode is rotated at high speed during operation of the tube. It is to be appreciated that the invention is also applicable to stationary anode x-ray tubes, rotating cathode tubes, and other electrode vacuum tubes.

Figure 2:
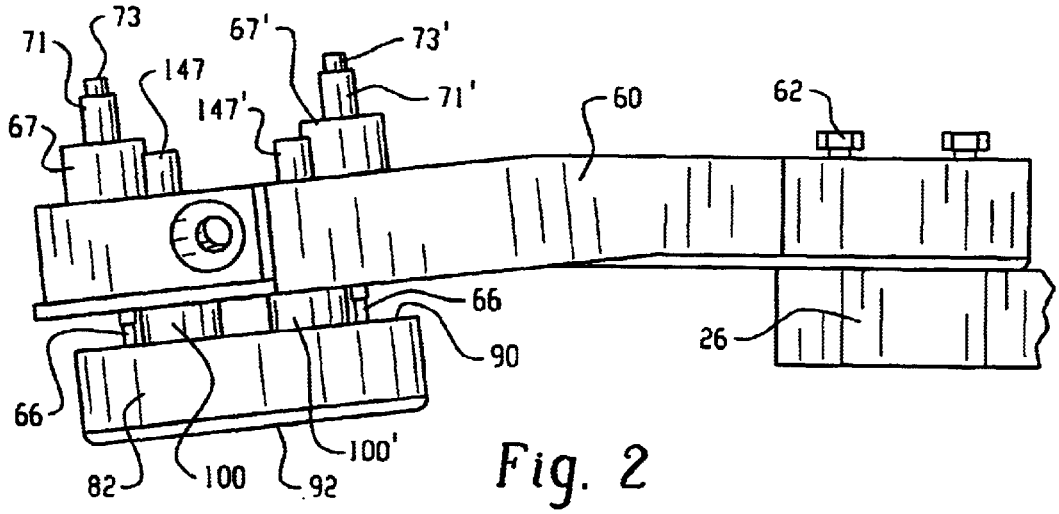
FIG. 2 is a side view of a cathode assembly of the x-ray tube of FIG. 1.
Figure 3:
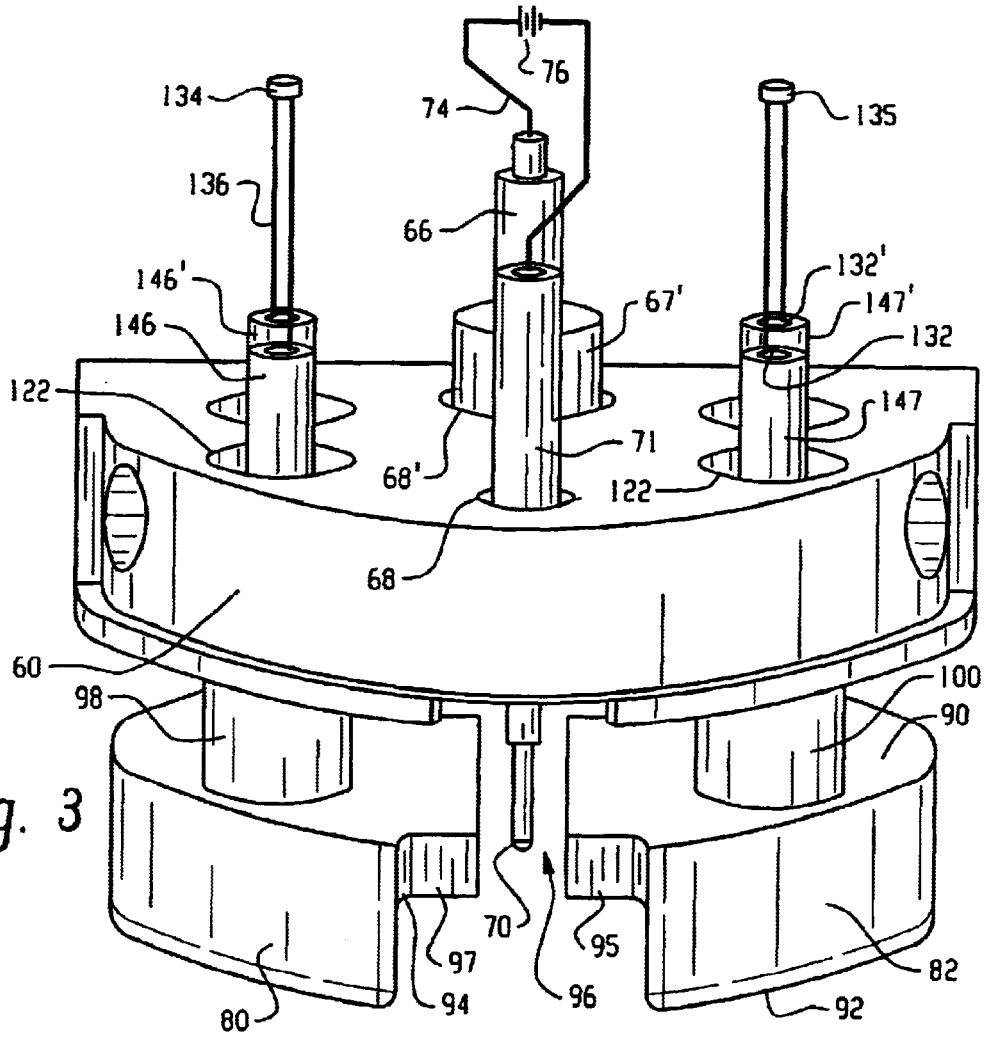
FIG. 3 is a front perspective view of the cathode assembly of FIG. 2.
Figure 4:
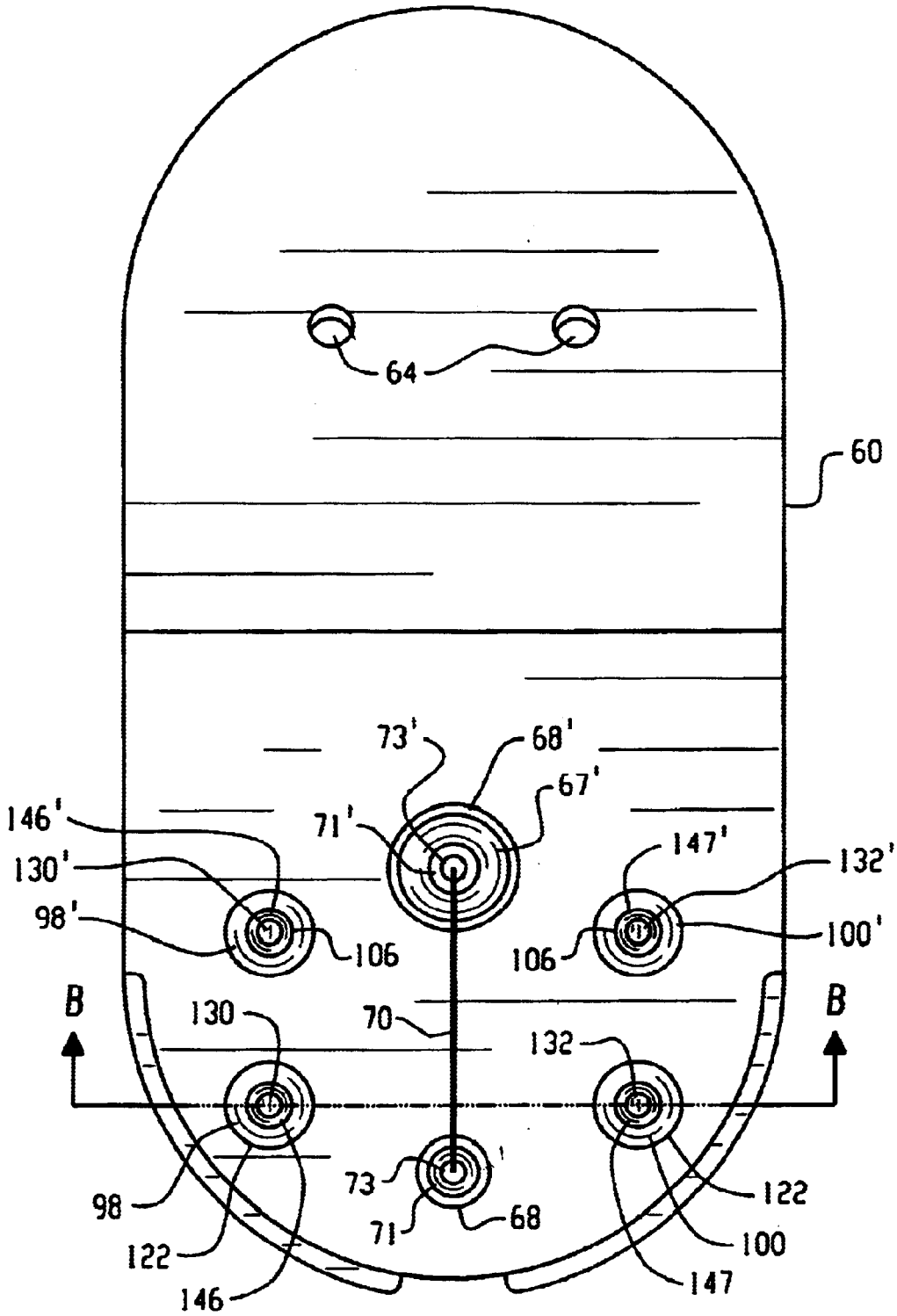
FIG. 4 is a top view of the cathode assembly of FIG. 2.
Figure 5:
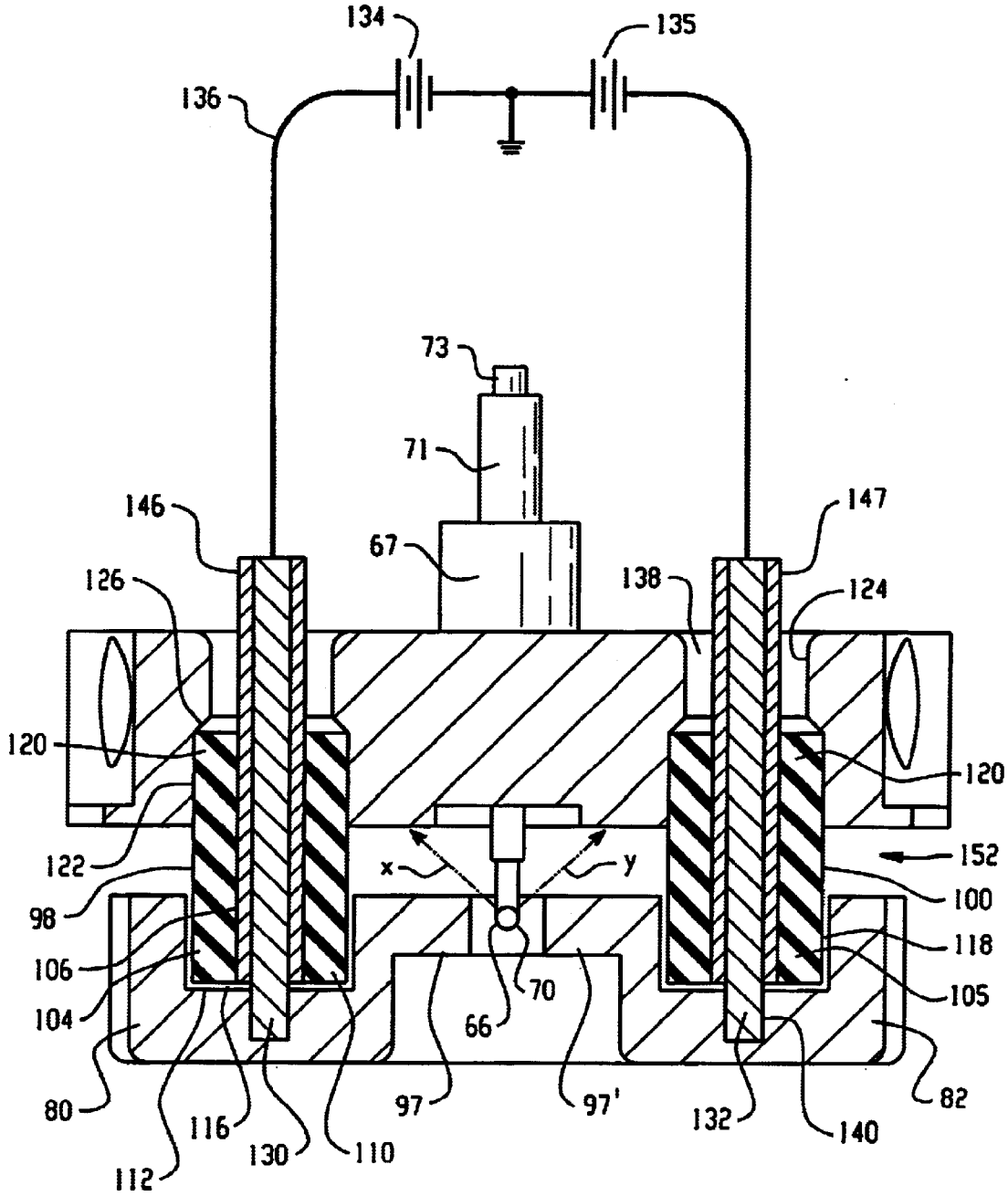
FIG. 5 is a sectional view of the cathode assembly through line B—B of FIG. 4.

With reference now to FIGS. 2–6, the cathode head 24 includes a base 60, which may be integrally formed with the arm 26 or mounted thereto, for example, by brazing or welding, or by affixing the arm to the base with bolts 62 or other suitable attachment members threaded through holes 64 in the base (FIG. 4). A filament assembly 66 is supported by the base. As shown in FIG. 2, two insulative filament supports or posts 67, 67' are provided for supporting respective ends of the filament. Alteratively, as shown in FIG. 3, one of the insulative filament supports is omitted, and the filament is grounded through the base 60. The support or supports 67, 67' are received through corresponding bores 68, 68', which extend axially through the base such that an electron-emitting portion or tip 70 of the filament assembly is spaced from the base. The filament supports may be fixed in this position by brazing the filament supports 67, 67' to the respective bore or by other means, such as threading a threaded portion of the filament supports 67, 67' to corresponding threads in the respective bore. It will be appreciated that two or more filament assemblies may be used in place of the single filament assembly shown, if desired. The filament supports 67, 67' may be formed from ceramic, or other suitable insulative material. Preferably, each support has a tube 71, 71' of nickel and/or Kovar™ brazed into an interior bore thereof (not shown). In the case of the embodiment of FIG. 3, the tube 71 is received through corresponding bore 68, and is preferably brazed directly thereto. Niobium shanks 73, 73' at ends of the tungsten filament are received through respective bores in the tubes 71 after the tubes have been mounted in the respective filament support or supports 67, 67' (FIG. 5). When it is time to position the filament 66, the two niobium shanks at the ends of the filament are inserted into the respective tubes 71. A microscope is used to adjust the height of the filament tip 70. When the filament tip is correctly positioned relative to the base 60, the tubes 71, 71' are crimped around the respective shanks 73, 73' to maintain the position of the filament until welding takes place, for example, by laser welding the shanks to the tubes 71, 71'. Prior to welding, the tungsten filament is preferably annealed to grow the filament into a single crystal tungsten structure, for example, by flashing a high current through the filament in a hydrogen atmosphere.

The filament assembly 66 is connected by conductors 74 to a suitable power source 76 outside the envelope (FIG. 3). Although a wire filament is illustrated, it is to be understood that other electron sources are also contemplated, including thin film filaments, and the like.

Deflectors 80, 82 are carried by the base 60 in a manner which electrically insulates the deflectors from the base. Two deflectors are shown in FIG. 3, although a single deflector, or more than two deflectors, could alternatively be used. The deflectors are positioned in close proximity to the filament tip 70 for deflecting and/or focussing the beam of electrons emitted by the filament. This allows the size and location of a focal spot 86 on the target (FIG. 1) to be controlled and adjusted.

As shown in FIG. 3, the deflectors 80, 82 are generally mirror images of each other and are positioned on opposite sides of the filament tip 70. Each deflector has an upper surface 90 and lower surface 92 (the terms "upper" and "lower" being used with reference to the orientation shown in FIG. 3, the upper surface being closer to the base 60). A side wall 94 of the deflector projects inwardly, towards the filament, in the region of the filament tip 70, thus providing a relatively narrow gap 96 between respective projecting portions 97, 97' of the two deflectors in the region of the filament tip.

The deflectors 80, 82 may be formed from molybdenum, or other suitable temperature resistant, electrically conductive material. The base 60 may also be formed from molybdenum, or may be formed from less expensive, easier to machine materials, such as nickel, since it does not need to withstand as high temperatures as the deflector.

Figure 6:
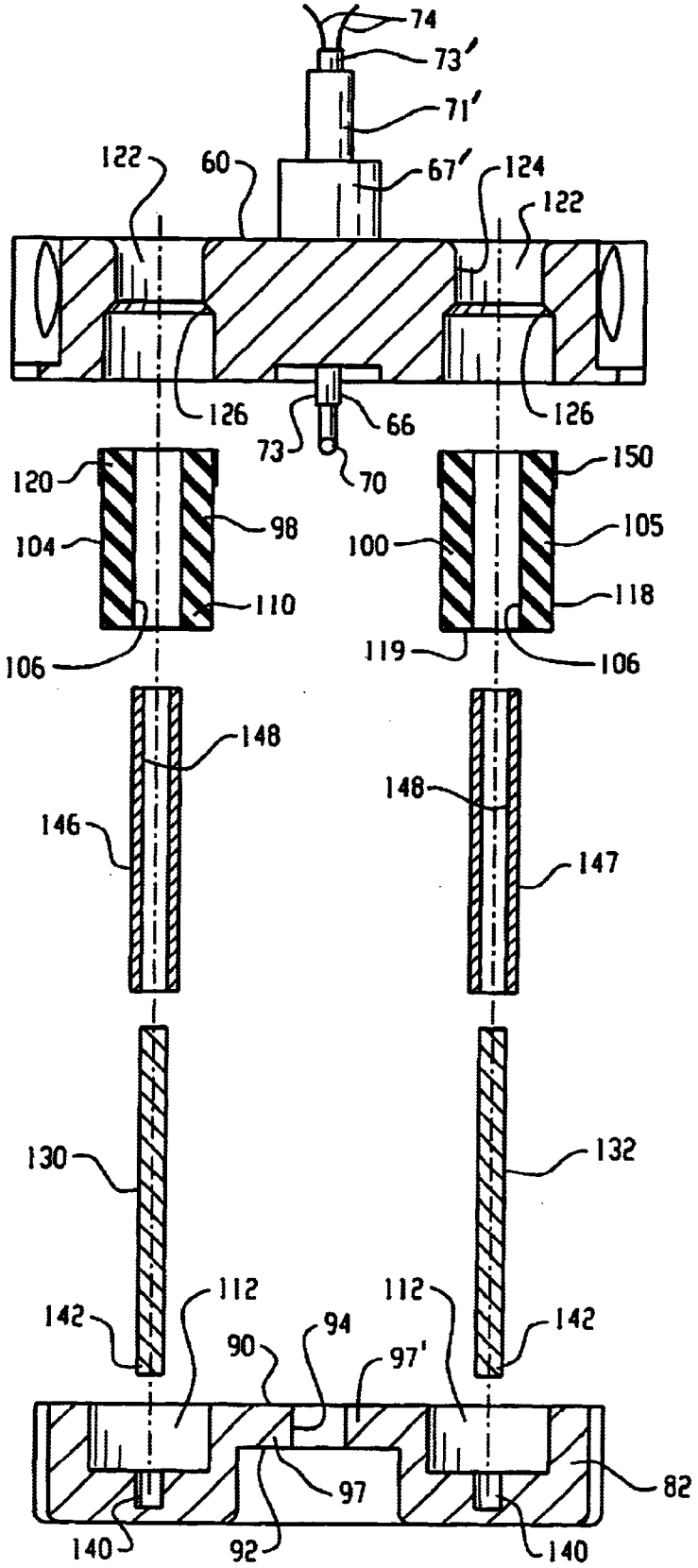
FIG. 6 is an exploded perspective view of the cathode assembly of FIG. 2.

With particular reference to FIGS. 4 and 6, the deflectors 80, 82 are spaced and insulated from the base by insulators 98, 100, 98', 100'. As shown in FIG. 4, four insulators are employed, two for each deflector. For stability, it is preferable to use two (or more) insulators for each deflector, spaced longitudinally from each other, although it will be appreciated that a single insulator may be used. For ease of reference, the cathode will be described with reference to two deflectors, each having two insulators. As shown in phantom in FIG. 4, the filament tip 70 extends between the forward and rear shanks 73, 73' along a line which is generally coincident with the longitudinal axis of the base 60 and perpendicular to a line B—B between the forward pair of insulators 98, 100 and is equally spaced from each insulator 98, 100, 98', 100' at its closest point thereto.

As best shown in FIGS. 5 and 6, each insulator 98, 100, 98', 100' comprises a cylindrical block 104, 105, each with a central axial bore 106. A first, lower portion 110 of each block 104, 105 is received within a correspondingly shaped cylindrical socket 112 in the deflector 80, 82. It will be understood that different shaped insulator blocks may be used, such as rectangular blocks and a corresponding shaped socket in the defector provided. As will be appreciated, two sockets are formed in each deflector to receive corresponding insulator blocks, a total of four sockets in all. Each socket extends partway into the deflector, preferably, about half way.

The socket 112 has a slightly larger diameter than the corresponding block 104, 105, such that a gap 116 spaces the insulator from the deflector adjacent a cylindrical side 118 and preferably also a base 119 of the insulator block 104, 105. The gap 116 is preferably about 70–100 microns in width, such that a space is maintained between the insulator 104, 105, and the deflector 80, 82. This reduces the risk of shorting out. In service, insulators sometimes become coated with a plating layer formed by evaporation of filament material. Leaving a gap between the insulator and the deflector allows for a fairly thick layer of plating material to accumulate without resulting in shorting out.

A second upper (in FIG. 6) portion 120 of each insulator block 104, 105 is received within a cylindrical passageway 122 in the base (four passageways are shown in FIG. 4). The passageway 122 is chamfered to create a smaller diameter portion 124 at the upper end thereof with a shoulder 126 for providing an upper stop for the insulator block 104, 105.

The insulator blocks 104, 105 are formed from an electrically insulating material, such as alumina. For example, 94% purity or 99% purity alumina may be used, such as AD 94, AL 500, or equivalent purity. $Al_2O_3$ meeting ASTM Standard D2442 Type 4 is an exemplary insulating material. For effective electrical insulation of the deflector from the base (and the filament), the insulators preferably provide a resistance of at least 720 giga-ohm.

A pair of deflector rods 130, 130', 132, 132', formed from an electrically conductive material, such as niobium, are mounted to each deflector 80, 82 (i.e., four rods in total) and are received through the corresponding bore 106 of the insulator blocks 104, 105. The deflector rods 130, 130', 132, 132' are electrically connected to a respective bias supply 134, 135 by suitable wiring 136 (FIG. 3). One bias supply is preferably provided for each deflector. The rod is electrically insulated from the base 60 by the corresponding insulator block 104, 105 and by a gap 138 at the upper end portion 124 of the insulator passage 122.

The deflector rods 130, 130', 132, 132' provide an electrically conductive path to the respective deflector 80, 82 for biasing the deflector to an appropriate voltage for deflecting or focusing the electron beam. For example, as the two deflectors 80, 82 both become more negative, relative to the filament, the size of the focal spot is reduced. When they become sufficiently negative, the electron beam is turned off. If one deflector is more negative than the other, the focal spot moves away from the more negative part. This latter result can be achieved by biasing only one of the deflectors and having the other deflector at the same potential as the filament. Because of the close proximity of the deflectors to the filament, a small bias is able to deflect or focus the beam. The two bias supplies 134, 135 may be computer controlled to permit automatic control of the width and positioning of the focal spot to a multiplicity of locations.

Each rod 130, 130', 132, 132 is preferably brazed to the deflector prior to insertion of the rod in the corresponding insulator block bore 106. As shown in FIG. 6, each deflector has a depression 140, such as central hole machined in the base of each socket 112, and shaped to receive one end 142 of the respective rod 130, 130', 132, 132. To attach the rod to the deflector, the rod is positioned in the hole 140, together with a small piece of a suitable braze material, and the assembly heated to an appropriate temperature to braze the two components 130, 80 together.

In an alternative embodiment, pairs of deflector rods 130, 130' and 132, 132', respectively, are connected at their ends 142 by a connecting portion (not shown) to form a generally U-shaped member. In this embodiment, the depression 140 takes the form of a slot, shaped to receive the connecting member therein. The connecting portion is positioned in the slot 140, together with a small piece of a suitable braze material, and the assembly heated to an appropriate temperature to braze the two components together. Other methods of attaching the rod 130, 132 to the deflector 80, 82 are also contemplated.

Each of the insulator blocks 104, 105 preferably has a cylindrical tube 146, 147, 146', 147' mounted axially in the central bore 106 for receiving the corresponding rod. Although only two tubes 146, 147 and two blocks are shown in the view of FIG. 6, it will be appreciated that a tube is provided for each insulator block. Thus, for this embodiment, four tubes 146, 147, 146', 147' are employed, as shown in FIG. 4. Each passageway, insulator block bore, and corresponding tube and rod are preferably concentrically arranged, as shown in FIG. 4. As shown in FIG. 5, the tube 146, 147 has an upper end which extends beyond the upper end of the insulator block, when installed, and is preferably of sufficient length to extend above the base 60 when the insulator block 104, 105 is located in the base. At a lower end, the tube 146, 147, when installed, is preferably flush with the base 119 of the insulator block, or may be slightly set back within the block.

The tube 146, 147 has an axially extending bore 148 therethrough with an internal diameter which is only slightly larger than the diameter of the corresponding rod 130, 132 so that the rod fits snugly in the tube bore. For example, the rod 130, 132 may have an OD of 0.100 cm+0.000/−0.018 and the corresponding tube 146, 147 an ID of 0.104 cm+0.025/−0.000. The tube is preferably formed from a material which is readily welded to the rod, for example, by laser welding. Exemplary materials for forming the tube include nickel and Kovar™. The tube 146, 147 is attached to the insulator block 104, 105 by brazing the two parts together, for example, by heating the tube and block with a suitable braze material between them. The quantity of braze material used should be sufficient to attach the parts firmly, without overflowing significantly at ends of the insulator block. This step is preferably carried out prior to inserting the insulator block into the base passageway 122.

The insulator blocks 104, 105 for the deflectors and the insulative support(s) 67, 67' for the filament assembly 66 (or tube 71, in the case of the embodiment of FIGS. 3 and 4) are brazed to the cup base 60 by heating the base and insulator, together with a suitable brazing material. The deflector insulator blocks 104, 105 and the insulative supports 67, 67' may be brazed into the base at the same time. However, in this embodiment, because the insulator blocks 104, 105 are inserted from the bottom of the base and the insulative support(s) 67, 67' for the filament are inserted from the top of the base, it may be preferable to braze first one set of insulators (either the filament or the deflector insulators) and then flip the base over and braze the other set of insulators.

The brazing material for the insulator blocks 104, 105 is preferably positioned in the shelf region. The brazing material can be the same type as is used to attach the tube to the insulator block and the rod to the deflector. However, since the brazing is preferably carried out in three separate steps (rod to deflector, tube to block, and block to base), the brazing material for each of the three joints can be a different material which is compatible with the parts to be joined and heated to an appropriate temperature for the respective braze material to melt.

To provide a suitable surface for brazing, the insulator block preferably has a very thin surface coating 150 of a metallizing material, such as a molybdenum-manganese or tungsten-manganese composite material (shown exaggerated in the thickness in FIG. 6). The coating may be deposited on the block by suitable deposition techniques to a thickness of about 5–20 microns. Preferably, the metallizing layer extends over only a portion of the outer surface of the blocks, such as at the upper end of the block in the region where the braze material will be applied, to minimize risk of shorting between the base and the deflector.

The insulator tubes 146, 147 are welded or otherwise attached to the rods 130, 132, for example, by laser welding. This step is preferably carried out after the insulators 104, 105 have been brazed into the base. This allows the deflectors to be properly aligned with the filament. The length of the deflector rods 130, 132 is preferably selected such that, when the deflectors are correctly positioned, the rods are level with or protrude by a small amount from the upper ends of their respective tubes 146, 147.

To ensure alignment of the filament tip 70 with the deflectors, the insulative filament posts 67, 67' are preferably seated in the base 60 and the ends of the filament 66 positioned (crimped, or crimped and welded) before inserting the deflector rods 130, 132 into the insulator tubes 146, 147. The rods are then inserted into their respective tubes. A gauge (not shown) of the appropriate thickness is then inserted between the deflector and the base to determine an appropriate gap 152 between the deflector and the base. The base and deflector are pushed towards each other (the rods sliding in their respective tubes) until the base and deflector contact the gauge.

Prior to laser or otherwise welding the insulator tubes 146, 147 to the deflector rods 130, 132, the respective insulator tubes and rods are optionally crimped together to hold the desired set position. The two deflectors 80, 82 are preferably positioned so that the filament tip 70 is approximately halfway between top and bottom surfaces of the deflector. This minimizes the risk of metallization of the insulator by material evaporating from the filament and avoids a "line of sight" being created in which material from the filament can travel in a straight line to the insulator. As can be seen from FIG. 5, the deflectors are positioned such that material evaporating from the filament tip 70 will be inhibited by the projections 97, 97' from traveling directly towards the insulator blocks, the closest direct paths x and y to the insulators 98, 100 taking the material to the base 60, rather than to the insulator.

Figure 7:
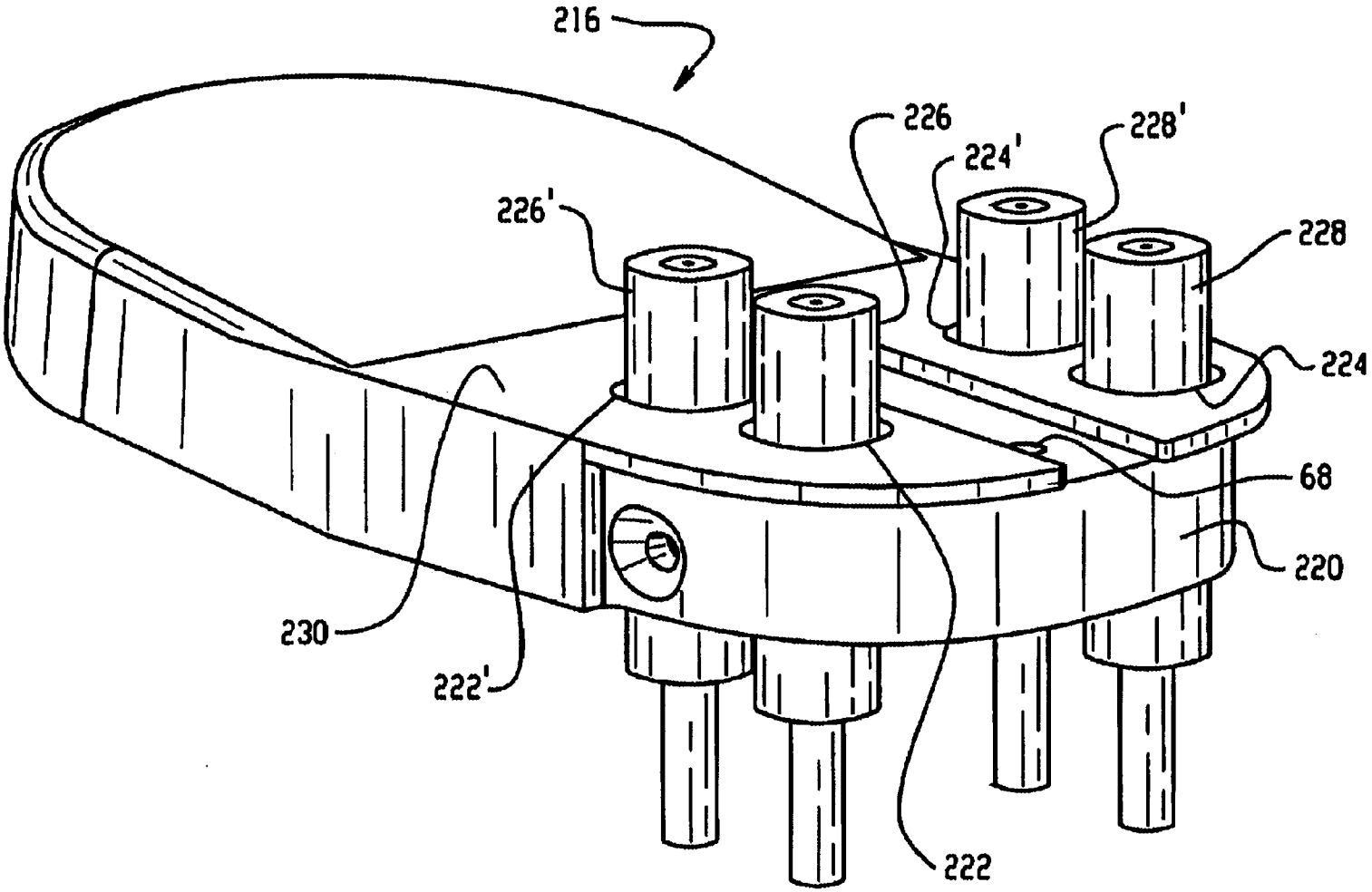
FIG. 7 is an enlarged perspective view of a cathode assembly according to an alternative embodiment of the invention.
Figure 8:
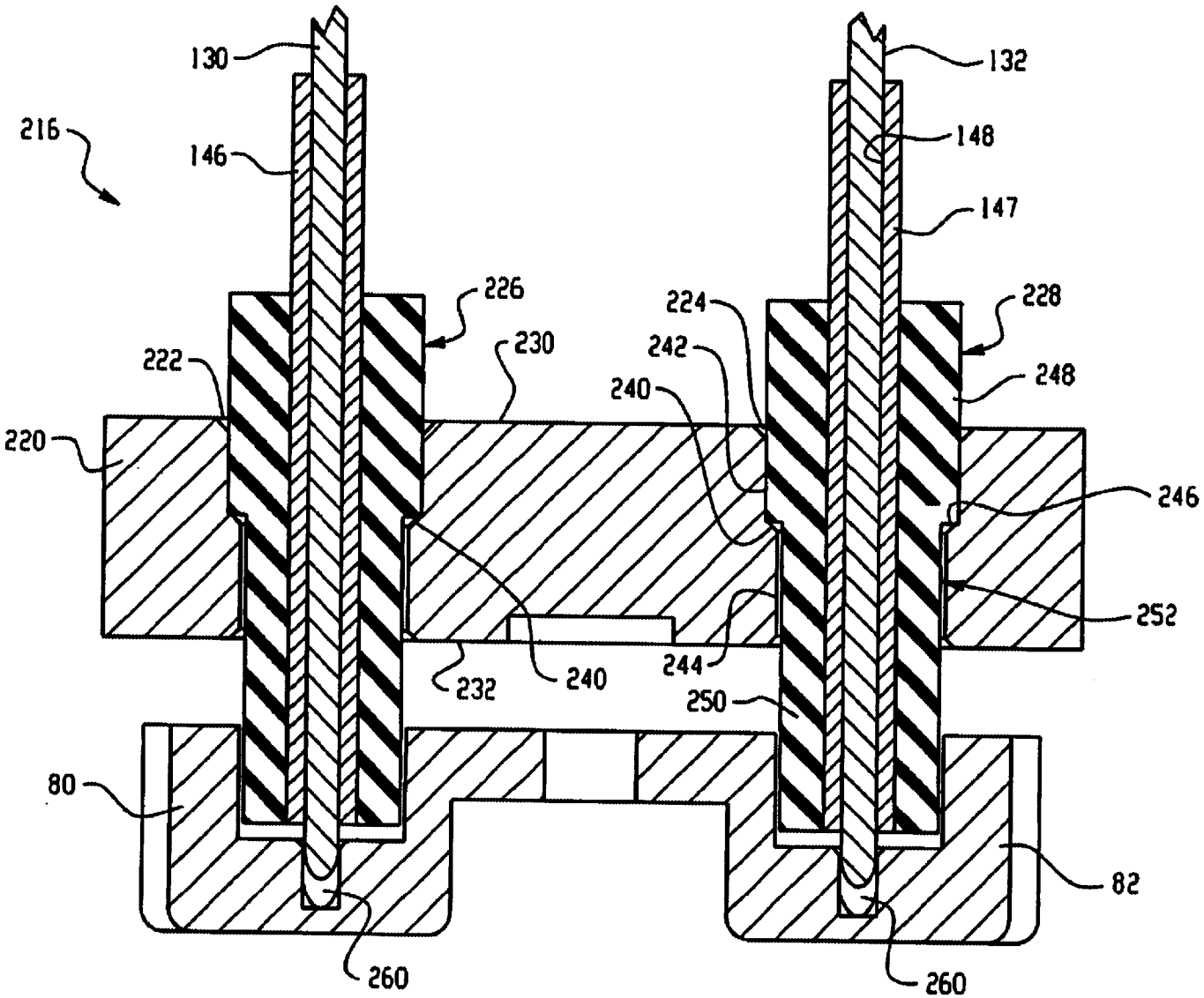
FIG. 8 is a sectional view of the cathode assembly of FIG. 7.

In an alternate embodiment, illustrated in FIGS. 7 and 8, a cathode assembly 216 is shown. The cathode assembly is similar to assembly 18 and includes a base 220, similar to base 60, with four bores 222, 222', 224, 224' for receiving deflector insulator blocks 226, 226', 228, 228'. The bores and insulator blocks are similar to those shown in FIGS. 2–6. However, in this embodiment, the bores are constructed for the insulator blocks to be mounted from an upper surface 230 of the base, rather than from the lower surface 232, as is the case in the embodiment of FIGS. 2–6. This allows the cathode filament support(s) 67, 67' (not shown) and the insulator blocks 226, 226', 228, 228' to be mounted from the same side 230 of the base and facilitates brazing by allowing the cathode filament supports 67, 67' and insulator blocks 226, 226', 228, 228' to be readily brazed in the same operation.

As shown in FIG. 8, the bores each have an tapered shoulder portion 240 between a widened upper portion 242 and a narrower lower portion 244 of the bore. The insulator blocks 226, 226', 228, 228' are shaped with a shoulder portion 246 between a widened upper portion 248 and a narrower lower portion 250 of the block. The lower portion of the block is received at its lower end by the corresponding deflector 80, 82. The shoulder portion 246 of the block sits on the bore shoulder portion 240. Prior to brazing, a small amount of brazing material is placed in the generally triangular space between the two shoulders 246, 240 for sealing the two components together when brazed. The shoulder portion 246 of the insulating block may be metallized prior to inserting the block into the bore to provide a good weld joint. An insulation gap 252 may be provided between the narrow portion 250 of the insulating block and the lower portion 244 of the bore. The gap ensures that even if a small portion of material evaporated from the filament tip enters the lower portion of the bore, it is deposited adjacent the surface 232, and the insulative barrier between the deflector and the base is not impaired. A similar arrangement (not shown) is used for brazing the filament support(s) 67, 67 into the respective bores 68, 68' to that described previously. Assembly of the cathode assembly 216 is otherwise the same as for the embodiment of FIGS. 2–6.

Other components of the cathode assembly are analogous to those described for the embodiment of FIGS. 2–6 and are given the same numerals. As for the earlier embodiment, deflector rods 130, 132 are brazed to the deflectors 80,82 with brazing material 260 (FIG. 8). The rods are then positioned in the respective tube bores 148 and, after adjusting the height of the deflector, the tubes are crimped and welded or otherwise attached to the rods.

While in this embodiment, both the deflector insulator blocks and the filament supports are inserted from the top of the block, it is also contemplated that the base may be configured for inserting both the insulator blocks and filament supports from the bottom of the base.

A preferred method of assembling the cathode is thus as follows:

a) braze the rods 130, 132 to the deflectors 80, 82, b) braze the tubes 146, 147 to the insulator blocks 104, 105, c) braze the insulator blocks 104, 105 (or 226, 228) and filament supports 67, 67' (or tube 71) to the base 60, d) set the filament tip 70 height by positioning and fixing filament shanks 73, 73' into tubes 71, 71' in the insulative supports 67,67', e) set the deflector height with a gauge and crimp the tubes 146, 147 to the rods 130, 132, f) weld the tubes 146, 147 to the rods 130, 132.

As will be appreciated, step b) may alternatively be carried out before or concurrently with step a) and steps a), b), and/or c) may be carried out after step d).

Assembling the components stepwise, with three separate brazing steps a), b), c), and a welding step f), rather than brazing the insulator to the base and to the deflector in a single brazing operation, minimizes tolerance stackups due to improper alignment of the three components. The deflectors 80, 82 are easily aligned with respect to the filament tip 70, simply by sliding the rods 130, 132 up and down in their respective tubes 146, 147. Having two (or more) tubes which fit snugly to the corresponding rods and thus guide their movement ensures that the deflector remains parallel with the base as it is being positioned.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A cathode assembly comprising:

a base;

a filament mounted to the base for delivering a stream of electrons;

a deflector carried by the base for deflecting the electrons or focusing the electrons into a beam;

an insulator for electrically insulating the deflector from the base, the insulator defining a bore;

a metal guide tube mounted in the insulator bore; and a rod connected with the deflector adjacent a first end of the rod, the rod being received in and aligned by an inner bore of the guide tube.

2. The cathode assembly of claim 1, further including:

a second deflector supported by the base;

a second insulator for electrically insulating the second deflector from the base, the second insulator defining a second bore; and a second rod, connected with the deflector adjacent a first end of the second rod, the second rod being received within the second insulator bore.

3. The cathode assembly of claim 1, further including:

another insulator for electrically insulating the deflector from the base, the other insulator defining another bore; and another rod, connected with the deflector adjacent a first end of the rod, the other rod being received within the other insulator bore.

4. A cathode assembly comprising:

a base which defines a passageway, the passageway including a first portion and a second portion, the second portion having a larger internal diameter than the first portion such that a shoulder is defined between the first and second portions;

a filament supported by the base for delivering electrons;

a deflector supported by the base for deflecting the electrons or focusing the electrons into a beam;

an insulator for electrically insulating the deflector from the base, the insulator defining a bore, a first end of the insulator being received in the passageway of the base, the insulator having a second portion of larger diameter than the first portion of the passageway which is received in the second portion of the passageway; and a rod connected with the deflector adjacent a first end of the rod, the rod being received within the insulator bore.

5. The cathode assembly of claim 1, wherein the base defines a passageway, a first end of the insulator being received in the passageway.

6. The cathode assembly of claim 4, further including a tube, mounted in the bore, which receives the rod.

7. The cathode assembly of claim 1, wherein the deflector defines a socket which receives a second end of the insulator.

8. The cathode assembly of claim 7, wherein the deflector defines a hole which extends into the deflector from the socket, the hole receiving the first end of the rod.

9. The cathode assembly of claim 8, wherein the deflector socket has a larger diameter than a diameter of the insulator, such that a gap is defined between the socket and a side wall of the deflector.

10. A cathode assembly comprising:

a base;

a filament mounted to the base for delivering a stream of electrons;

a deflector for deflecting the electrons or focusing the electrons into a beam, the deflector defining a well;

an insulator for electrically insulating the deflector from the base, the insulator defining a bore; and a rod received with the well of the deflector adjacent a first end of the rod such that the insulator is connected with the deflector by the rod and does not itself contact the deflector, the rod being received within the insulator bore.

11. A cathode assembly comprising:

a metal base;

a filament supported by the base for delivering electrons;

a deflector carried by the base for deflecting the electrons or focusing the electrons into a beam;

an insulator for electrically insulating the deflector from the base, the insulator defining a bore, and the insulator having a metallized coating on a first portion thereof, the insulator being brazed or welded to the base at the metallized coating; and a rod connected with the deflector adjacent a first end of the rod, the rod being received within the insulator bore.

12. The cathode assembly of claim 1, wherein the rod electrically connects the deflector with a source of electrical potential for biasing the deflector.

13. A cathode assembly comprising:

a base;

a filament supported by the base which emits electrons and vaporized filament material;

a deflector supported by the base for deflecting the electrons or focusing the electrons into a beam, the deflector being configured and positioned relative to the filament by a rod and an insulator to eliminate a direct line of sight for the vaporized filament material between the filament and the insulator, the insulator electrically insulating the deflector from the base.

14. The cathode assembly of claim 6, wherein the second portion of the passageway is adjacent an upper end of the base.

15. The cathode assembly of claim 2, wherein the first ends of the first and second rods are connected by a connecting member and wherein the connecting member is connected with the deflector.

16. An x-ray tube comprising:

an envelope which encloses an evacuated chamber;

a cathode assembly disposed within the chamber for providing a source of electrons, the cathode assembly including:

a base supported in the envelope, a filament mounted to the base for providing the electrons, a deflector carried by the base for deflecting the electrons or focusing the electrons into a beam, an insulator for electrically insulating the deflector from the base, the insulator defining an internal bore, and a rod connected with the deflector adjacent a first end of the rod, and an alignment tube which defines a bore mounted in the insulator bore, the tube receiving and aligning the rod; and an anode disposed within the chamber positioned to be struck by the electrons and generate x-rays.

17. A method of assembling a cathode assembly comprising:

a) attaching at least one rod to at least one deflector;

b) attaching a metal tube in an insulator to define a bore for receiving the rod;

c) attaching the insulator to a base;

d) attaching a filament assembly to the base;

e) sliding the rod into the tube to position the deflector to adjustably select a distance from the base; and f) attaching the rod to the tube mounting the deflector the selected distance from the base.

18. The method of claim 17, wherein the step of mounting the rod to the deflector includes positioning the first end of the rod in a hole within the deflector and brazing the rod to the deflector.

19. A method of assembling a cathode assembly comprising:

a) attaching at least one rod to at least one deflector;

b) attaching an insulator tube to a base including:

metalizing one end of an outer surface of the insulator tube;

positioning the metalized end of the insulator in a bore in the base; and brazing the metalized surface of the insulator to the base;

c) sliding the rod into a bore in the insulator tube to mount the deflector to the base while insulating the rod from the base; and d) attaching the rod to the insulator tube.

20. The method of claim 17, wherein the step of attaching the tube in the insulator includes:

inserting the tube in a bore in the insulator;

welding the tube to the insulator.

21. The method of claim 20, wherein the step of attaching the rod to the tube includes:

crimping the rod and the tube together.

22. The method of claim 17, further including:

as the rod is slid into the tube, setting and aligning the deflector;

performing the step of attaching the rod to the tube after the deflector has been set in a preselected position with a preselected alignment.

23. A method of assembling a cathode assembly comprising:

a) attaching at least one rod to at least one deflector;

b) attaching a metal tube in an insulator to define a bore for receiving the rod;

c) inserting the insulator into a bore of a base from a first surface of the base;

d) inserting a filament insulator into a second bore of the base from the first surface of the base; and e) brazing the insulator and filament insulator to the base in a single brazing step;

f) sliding the rod into the tube to mount the deflector to the base; and g) attaching the rod to the tube.

* * * * *